US007021815B1

(12) United States Patent
Yang

(10) Patent No.: US 7,021,815 B1
(45) Date of Patent: Apr. 4, 2006

(54) HALOGEN LAMPHOLDER

(75) Inventor: Wen Ho Yang, Taipei (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 11/244,276

(22) Filed: Oct. 6, 2005

(51) Int. Cl.
*H01R 33/00* (2006.01)

(52) U.S. Cl. ..... 362/655; 362/652; 439/699.2

(58) Field of Classification Search ..... 362/368, 362/652, 655, 656, 658, 659; 439/699.2
See application file for complete search history.

(56) References Cited

U.S. PATENT DOCUMENTS 4,631,651 A * 12/1986 Bergin et al. ..... 362/267
4,804,343 A * 2/1989 Reedy ..... 439/854
5,008,588 A * 4/1991 Nakahara ..... 313/318.1
5,558,543 A * 9/1996 Takano et al. ..... 439/699.2
6,626,707 B1 * 9/2003 Henrici et al. ..... 439/699.2
6,692,308 B1 * 2/2004 Henrici et al. ..... 439/699.2

* cited by examiner

*Primary Examiner*—Alan Cariaso
*Assistant Examiner*—Adam C. Rehm
(74) *Attorney, Agent, or Firm*—Bacon & Thomas, PLLC

(57) ABSTRACT

A halogen lampholder includes a base, a locking spring, two clipping members, two sliding members, a bottom cover, an outer shell and an outer ring. The base is assembled with the locking spring, the clipping members and the sliding members and then, with the bottom cover and the outer shell orderly. The base has a vertical plugging chamber for a fitting portion and two conducting teeth of a lamp to plug in. The locking spring clamps the fitting portion of the lamp. The clipping members connect with the conducting teeth. The sliding members are placed in the base to restrain the locking spring. The bottom cover restrains the locking spring and the clipping members. The outer shell covers the bottom cover, combined with an outer ring and a power-wire tube for a power wire to pass through and reach the clipping members.

3 Claims, 6 Drawing Sheets

(A-A)

(B-B)

HALOGEN LAMPHOLDER

BACKGROUND OF THE INVENTION

1. Field of the Invention

This invention relates to a halogen lampholder, particularly to one composed of plural independent components, able to be simply assembled stably and disassembled conveniently.

2. Description of the Prior Art

A conventional halogen lampholder is always made in a fixed solid structure, that is, it cannot be disassembled without causing partial damages. Such a fixed structure not only costs higher for design and manufacturing, but also involves a rather complicated and tough way of assembling. Besides, that the conventional one is unable to be disassembled after having been assembled is very inconvenient in practical use. Therefore, this invention has been devised to overcome the defects as mentioned above.

SUMMARY OF THE INVENTION

The prime object of this invention is to offer a halogen lampholder able to be disassembled into plural components, providing simple manufacturing casts for saving cost, easy assembling and disassembling, and a convenient maintenance. Moreover, if any of the independent components is damaged or out of work, it can be replaces with a new one instead of replacing a new whole lampholder, saving cost and reduce consumption of energy for environmental protection.

The main characteristics of the invention are a base, a locking spring member, two clipping members, two sliding members, a bottom cover, an outer shell and an outer ring. The base has a vertical plugging chamber at its one end for a fitting portion of a halogen lamp and two conducting teeth under the fitting portion to plug in, two accommodating chambers at its front and rear side respectively connected with the vertical plugging chamber by a connecting groove at its bottom for containing a locking spring member. The locking spring member possesses a transversal leaning plate and a locking plate set to extend upright from two sides of the transversal leaning plate respectively. Each locking plate is formed of a hump in its intermediate portion and a bended clipping end at its top. The transversal leaning plate is put in the connecting groove. The locking plates are placed in the accommodating chambers. The bended clipping ends are settled in the vertical plugging chamber for clamping the fitting portion of the lamp. Each accommodating chamber has a sliding groove at its two sides respectively for a sliding rail provided at two sides of a sliding member respectively to move along. Each sliding member has a projecting pusher at its rear side for supporting the locking spring member on the spot near the hump. A bottom-fixing cavity is set at the bottom of the base and two sides of the connecting groove respectively, communicating with the vertical plugging chamber. Each bottom-fixing cavity is inserted by a clipping member that has a bended clipping end plugged into and to stay at the edge of the vertical plugging chamber, two fixing plates placed in the bottom fixing cavity and a wire clipping plate formed by a bended extension of the fixing plate. Each bended clipping end of the clipping member is in contact with each conducting tooth of a halogen lamp. Each wire clipping plate is pushed to get bended by one end of a power wire so that the power wire is clamped by the wire clipping plate and the fixing plates. The base has two fixing grooves and four locking grooves at the other end. Each sliding groove is formed of a transversal groove in its intermediate portion. The bottom cover is provided with hooks, a wall body and locking grooves around its circumference, a transversal locking bar and two piercing holes in its surface. The bottom cover is combined completely with the base by locking the hooks with the fixing grooves of the base, with the wall body fitting with the locking grooves and by supporting the transversal locking bar resting on the transversal leaning plate. The piercing holes are passed through by the power wire. The outer shell is provided with an opening for containing the base and the bottom cover at its one end and an interior threaded column for the power wire to pass through at the other end. Two projections are set symmetrically in the inner wall of the opening. The two projections are inserted in the locking grooves of the bottom cover and moved to reach and stay stably in the transversal grooves by rotating the outer shell against the base, finishing the assembly of the outer shell with the base. Finally, the sliding members are moved to the openings of the transversal grooves to prevent the projections from moving away so as to keep the base, the bottom cover and the outer shell assembled firmly together.

The outer shell is formed of male threads on its outer wall for screwing with inner female threads of an outer ring.

The outer shell is provided with an inner threaded column for screwing with an outer threaded portion of a power wire tube provided for the power wire to pass through.

BRIEF DESCRIPTION OF DRAWINGS

This invention is better understood by referring to the accompanying drawings, wherein.

DETAILED DESCRIPTION OF THE PREFERRED EMBODIMENT

Figure 1:
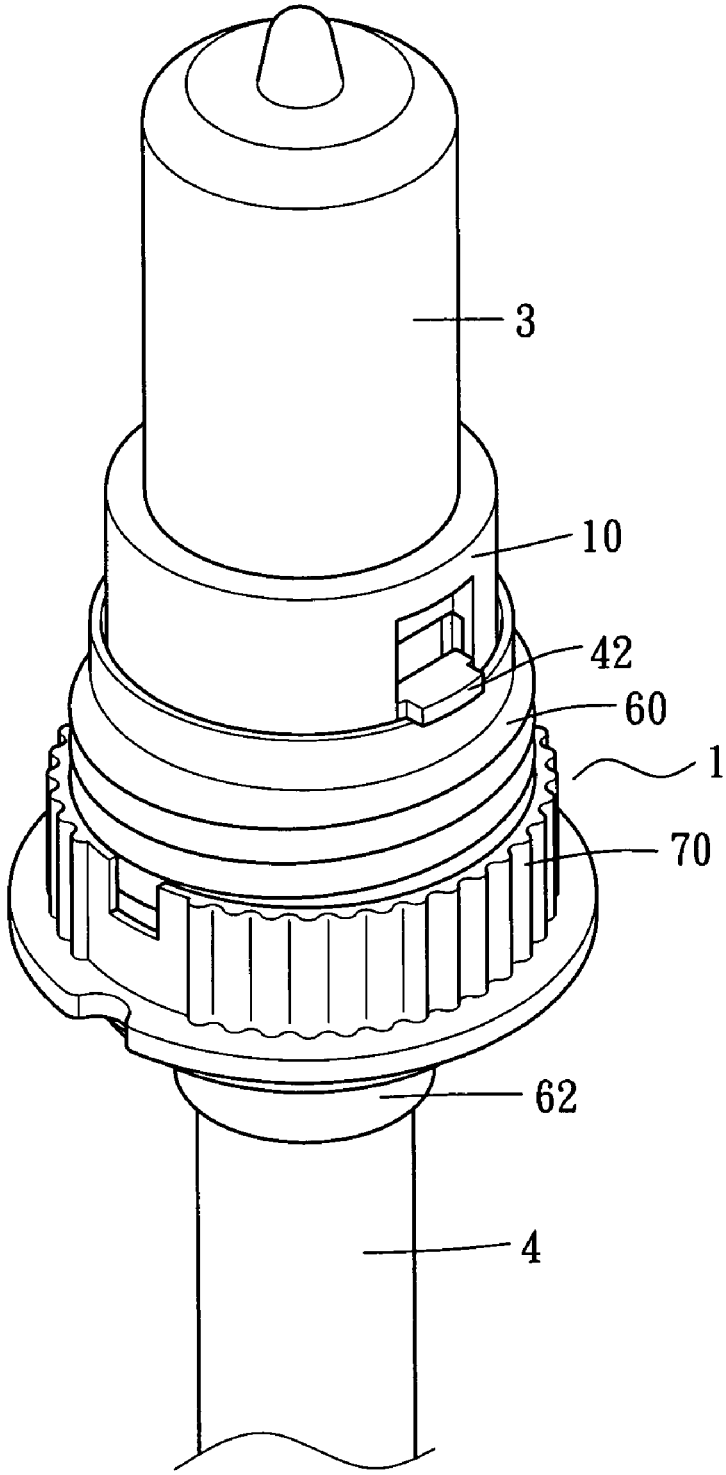
FIG. 1 is a perspective view of a preferred embodiment of a halogen lampholder in the present invention.
Figure 2:
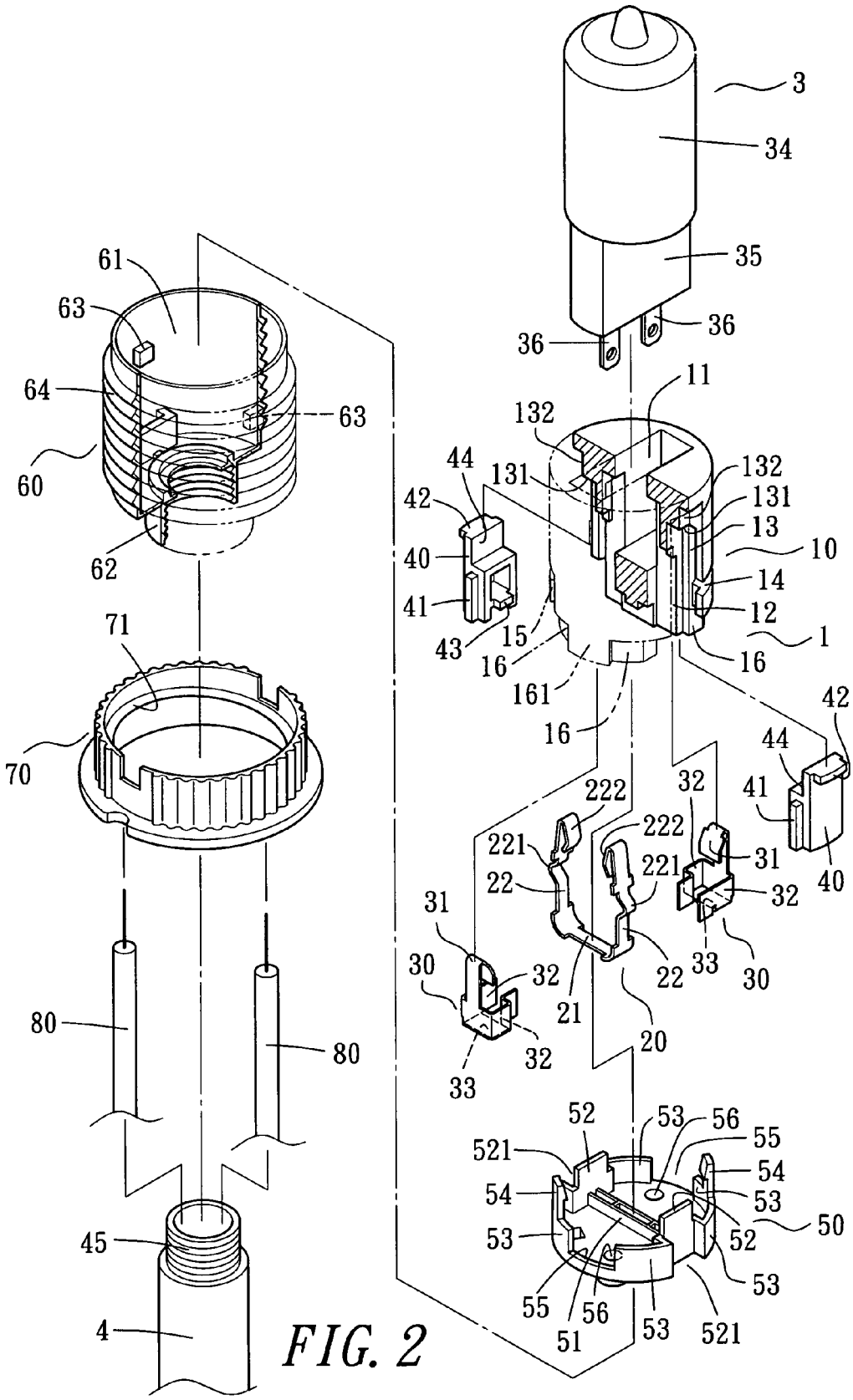
FIG. 2 is an exploded perspective view of the preferred embodiment of a halogen lampholder in the present invention.
Figure 3:
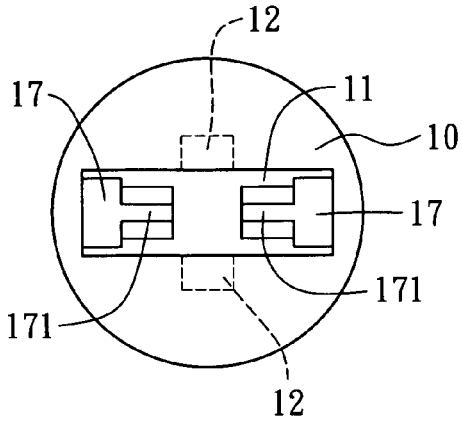
FIG. 3 is a top view of a base of the preferred embodiment of a halogen lampholder in the present invention.

As shown in FIG. 1, a preferred embodiment of a halogen lampholder 1 in this invention is to match with a halogen lamp 3. One end of the halogen lampholder 1 is to be connected with a power line tube 4 made from a rigid or a flexible material. Next, as shown in FIG. 2, the halogen lampholder 1 includes a base 10, a locking spring member 20, two clipping members 30, two sliding members 40, a bottom cover 50, an outer shell 60, an outer ring 70 and a power wire 80.

Figure 4:
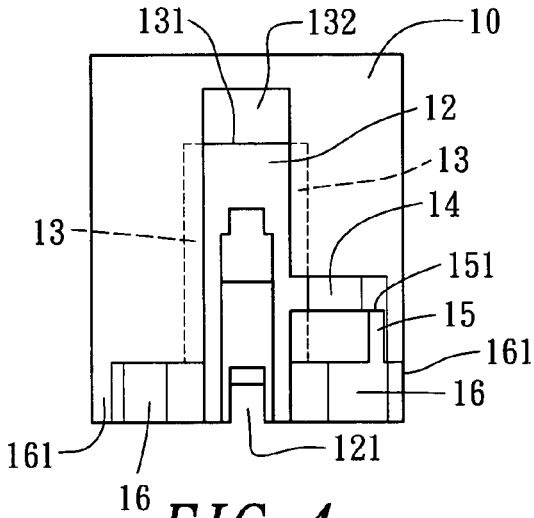
FIG. 4 is a front view of the base of the preferred embodiment of a halogen lampholder in the present invention.
Figure 5:
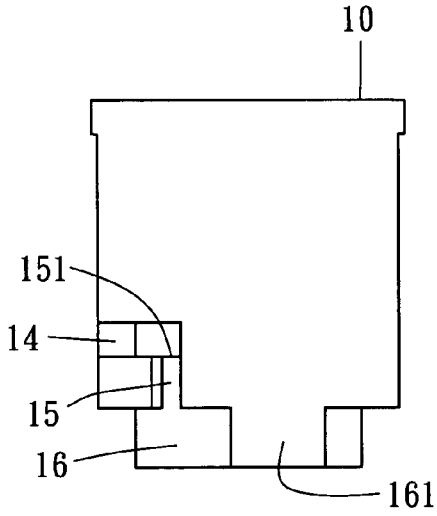
FIG. 5 is a right-side view of the base of the preferred embodiment of a halogen lampholder in the present invention.
Figure 6:
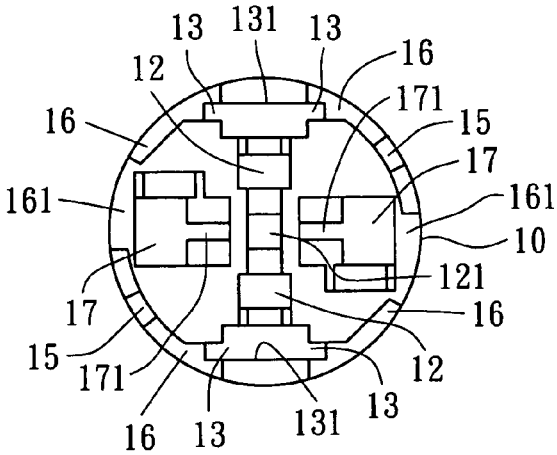
FIG. 6 is a bottom view of the base of the preferred embodiment of a halogen lampholder in the present invention.

The base 10 is made of ceramics and formed as a column shape. With references to FIGS. 3–6, the base 10 has a vertical plugging chamber 11 beginning from its top side and an accommodating chamber 12 located somewhat lower than the vertical plugging chamber 11 respectively in a front side (as shown in FIG. 4) and in a rear side and communicating with the two long sides of the vertical plugging chamber 11 respectively. Further, a connecting groove 121 is set at the bottom of the base 10, connecting the vertical plugging chamber 11 and the accommodating chamber 12. Each of the accommodating chambers 12 is formed with two sliding grooves 13 at its two sides closer to the upper surface. The top of each sliding groove 13 is blocked by a stopping edge 131 whose surface is formed of a flat groove 132 with a shorter depth from the upper surface of the base 10. One of the sliding grooves 13, the right one shown in FIG. 4, is provided with a transversal groove 14 near its intermediate portion. As shown in FIGS. 4 and 5, the outer portion of the transversal groove 14 is connected with an insert groove 15 located lower than the transversal groove 14 and passes downward. So, an interface 151 is formed at the meeting place of the transversal groove 14 and the fixing groove 15. In addition, out of the meeting place of each accommodating chamber 12 and each the connecting groove 121 in the bottom of the base 10 extends outwards to two sides respectively a locking groove 16. Further, the locking groove 16 at the right side shown in FIG. 4 is longer than the one at the left side and connected with the insert groove 15. The portion beside the locking grooves 16 in the bottom of the base 10 is a wall body 161. As shown in FIG. 6, viewed from the bottom of the base 10, in addition to the connecting groove 121, the accommodating grooves 12, the sliding grooves 13, the insert grooves 15, the locking grooves 16 and the wall body 161, we can also see a bottom fixing cavity 17, set at two sides of the connecting groove 121 respectively, connected to the vertical plugging chamber 11 and having a narrow clipping gap 171 connected to the vertical plugging chamber 11 too.

Figure 8:
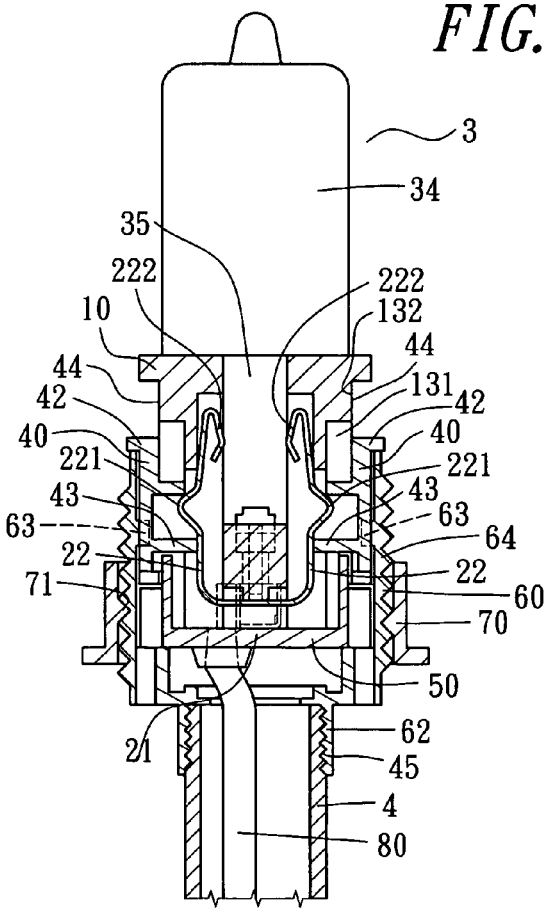
FIG. 8 is a cross-sectioned view of an A—A line in FIG. 7.

The locking spring member 20 is composed of a transversal leaning plate 21 and two locking plates 22 located to extend upright from its two sides of the transverse leaning plate 21. Each locking plate 22 is formed with a hump 221 in its intermediate portion and a bended clipping end 222 at its top. In assembling, put the transversal leaning plate 21 into the connecting groove 121 of the base 10 first and then, make the locking plates 22 to move upwards into the accommodating groove 12. In this condition, each hump 221 is staying in the accommodating groove 12 and each bended locking end 222 is staying at the inner edge of the vertical plugging chamber 11 as shown in FIG. 8.

Figure 9:
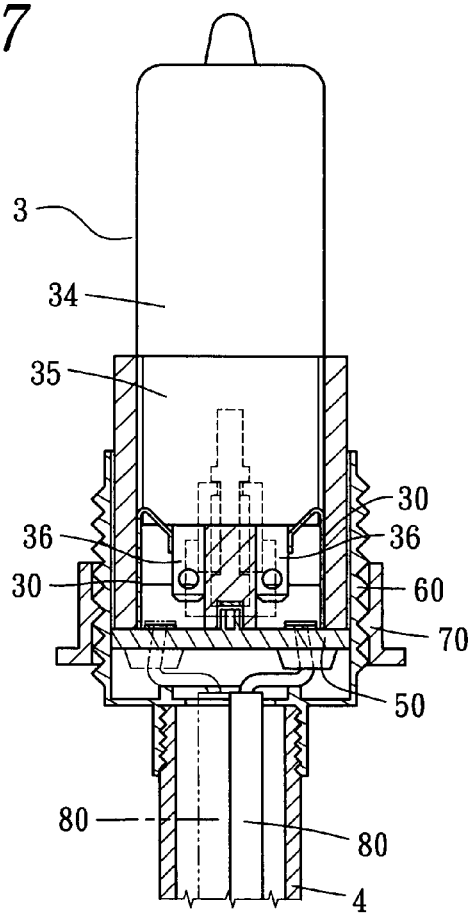
FIG. 9 is a cross-sectioned view of a B—B line in FIG. 7.

Each of the clipping members 30 is formed of a bended clipping end 31, two insert plates 32 and a wire clipping plate 33 that is a bended extension of one of the fixing plates 32 and connected between the bottom of the two insert plates 32. In assembling, as shown in FIG. 9, the insert plates 32 are plugged in the clipping gaps 171 of the bottom fixing cavities 17 and the bended clipping ends 31 stay at the bottom of the vertical plugging chamber 11.

Each of the sliding members 40 is provided with a vertical sliding rail 41 at its two sides respectively, a pushing ear 42 at the top of its front side, a projecting pusher 43 at the bottom of its rear side and a recessed surface 44 above the hump pusher 43. In assembling, keep each the sliding rail 41 of the sliding member 40 fit exactly with the sliding groove 13 of the base 10, and then push upwards the sliding member 40 so that the projecting pusher 43 may reach the hump 221 of the locking spring member 20. Next, push the pushing ear 42 to move over the hump 221 and urge on it. At this time, the recessed surface 44 reaches the stopping edge 131 of the base 10 and fits with the flat groove 132. Therefore, the locking spring member 20, being supported by the projecting pusher 43 from its two sides respectively, has a potential elasticity and an inclination to compress inwards.

The bottom cover 50 possesses a transversal locking bar 51 located between two plugging plates 52 that are formed concavely so as to form a locking groove 521 respectively on the surfaces of the plugging plates 52. Each of the plugging plate 52 is connected with a wall body 53, a hook 54 and a recess 55 orderly at its two sides respectively. The surface of the bottom cover 50 is cut with two piercing holes 56 located respectively near to one end of each recess 55. In assembling, at first, place the plugging plate 52 faced exactly to the bottom of the accommodating chamber 12 and insert it therein. By the time, the transversal locking bar 51 is to lean exactly on the transversal leaning plate 21 of the locking spring member 20, and each hook 54 is inserted into each fixing groove 15 and to hook with the interface 151. Then each plugging plate 52 and the wall body 53 at two sides of each hook 54 fit in the locking grooves 16 correspondingly and each recess 55 is occupied by each corresponding wall body 161. And, each the piercing hole 56 is facing to the non-connecting end of each wire clipping plate 33 of the clipping member 30 so that each pole of the power line 80, after being stripped off the plastics wrapped its end, can pass through the piercing hole 56 and push up the wire clipping plate 33 to reach the fixing plate 32 so as to enable it to be clamped together with the fixing plate 32, enabling the current to be conducted through to the clipping member 30 as shown in FIG. 9.

Figure 10:
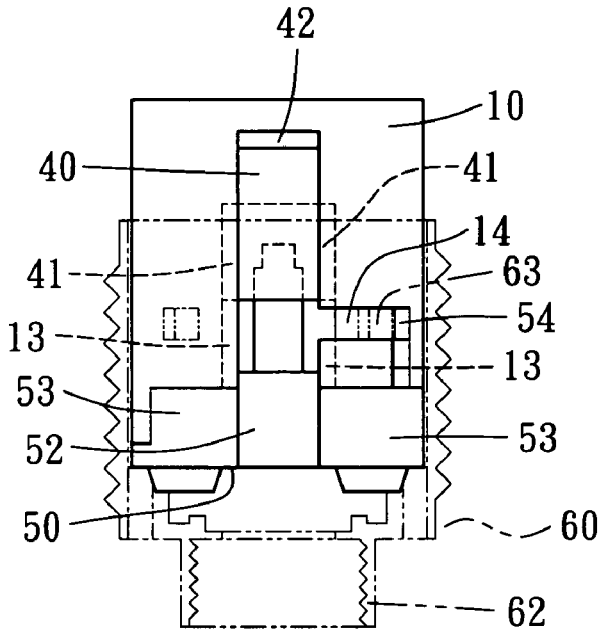
FIG. 10 is a front view of the base, a bottom cover and an outer shell of the preferred embodiment of a halogen lampholder in the present invention, showing it in a primarily assembled condition.
Figure 11:
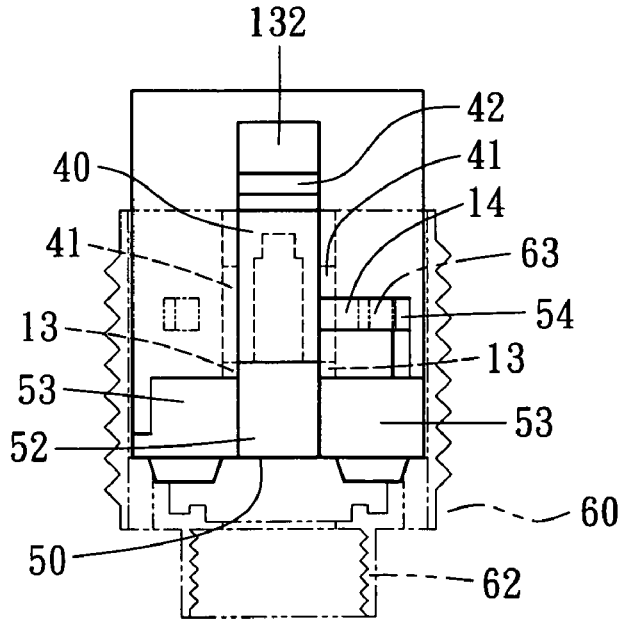
FIG. 11 is a front view of the base, the bottom cover and the outer shell of the preferred embodiment of a halogen lampholder in the present invention, showing it in a completely assembled condition.

The outer shell 60, as shown in FIG. 2, is shaped cylindrical, provided with an opening 61 at its top, an interior threaded column-shaped hole 62 at its bottom, two mutual symmetric projections 63 located a little lower than the opening 61 in the interior of the outer shell 60 and male threads 64 on its outer wall. After the base 10, the locking spring member 20, the clipping members 30, the sliding members 40 and the bottom cover 50 have been assembled orderly as mentioned above, keep the opening 61 of the outer shell 60 face to the bottom of the bottom cover 50 and the projections 63 to the locking grooves 521 of the bottom cover 50. Then, put the outer shell 60 around the bottom cover 50 and the base 10, with the projections 63 inserted in the locking grooves 521 correspondingly until they reach the bottoms of the sliding members 40. Next, rotate the outer shell 60 clockwise so as to enable the projections 63 to move into the transversal grooves 14 until it touches with the hooks 54 of the bottom cover 50 and remaining in place stably, achieving a fixing purpose and finishing the assembling of the outer shell 60 on the base 10. FIG. 10 shows the situation of the base 10, the bottom cover 50 and the outer shell 60 assembled in this stage. Next, the sliding members 40 must be moved downwards a little to become a situation as shown in FIG. 11. That is, when the sliding members 40 are moved downwards, the projecting pushers 43 inside them are to move over the humps 221 of the locking spring member 20 and still keep supporting the humps 221 with a potential elasticity and an inclination to compress inwards. The sliding members 40 are kept moving downwards until they are stopped by the plugging plates 52 of the bottom cover 50. By the time, the sliding members 40 is blocked at the openings of the transversal grooves 14, keeping the projections 63 unable to move away from the transversal grooves 14, achieving a steady assembled situation among the base 10, the bottom cover 50 and the outer shell 60. Finally, The outer ring 70, by engaging the inner female threads 71 with the outer male threads 64 of the outer shell 60 for rotation, can move up and down along the outer shell 60.

Figure 7:
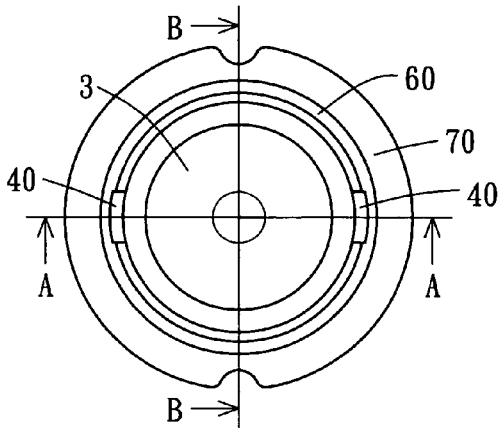
FIG. 7 is a top view of the preferred embodiment of a halogen lampholder in the present invention, showing it in an assembled and used condition.

In practical use, the inner threaded column 62 of the outer shell 60 is screwed tightly together with an outer threaded portion 45 of a power wire tube 4. A power wire 80 is made to penetrate through the power wire tube 4, the exterior threaded portion 45 and the inner threaded column 62, the interior of the outer shell 60 and the piercing holes 56 orderly to enter the wire clipping plates 33 so as to be clamped together with plugging plates 32, as shown in FIG. 9. The vertical plugging chamber 11 is provided to be plugged in by a halogen lamp 3. As shown in FIGS. 1 and 7, the halogen lamp 3 is provided with a lamp portion 34, a fitting portion 35 shrunk under the lamp portion 34 and two conducting teeth 36 extended down from the fitting portion 35. In assembling, keep the fitting portion 35 inserted into the vertical plugging chamber 11 of the base 10 to enable the fitting portion 35 to be clamped fixedly by the bended clipping ends 222, as shown in FIG. 8. Then, the conducting teeth 36 is plugged into the clipping gaps 171 fixedly, contacting with the bended clipping ends 31 as well, as shown in FIG. 9. So, electric current conducted to the clipping members 30 is able to flow to the conducting teeth 36 to light up the lamp 3.

Figure 12:
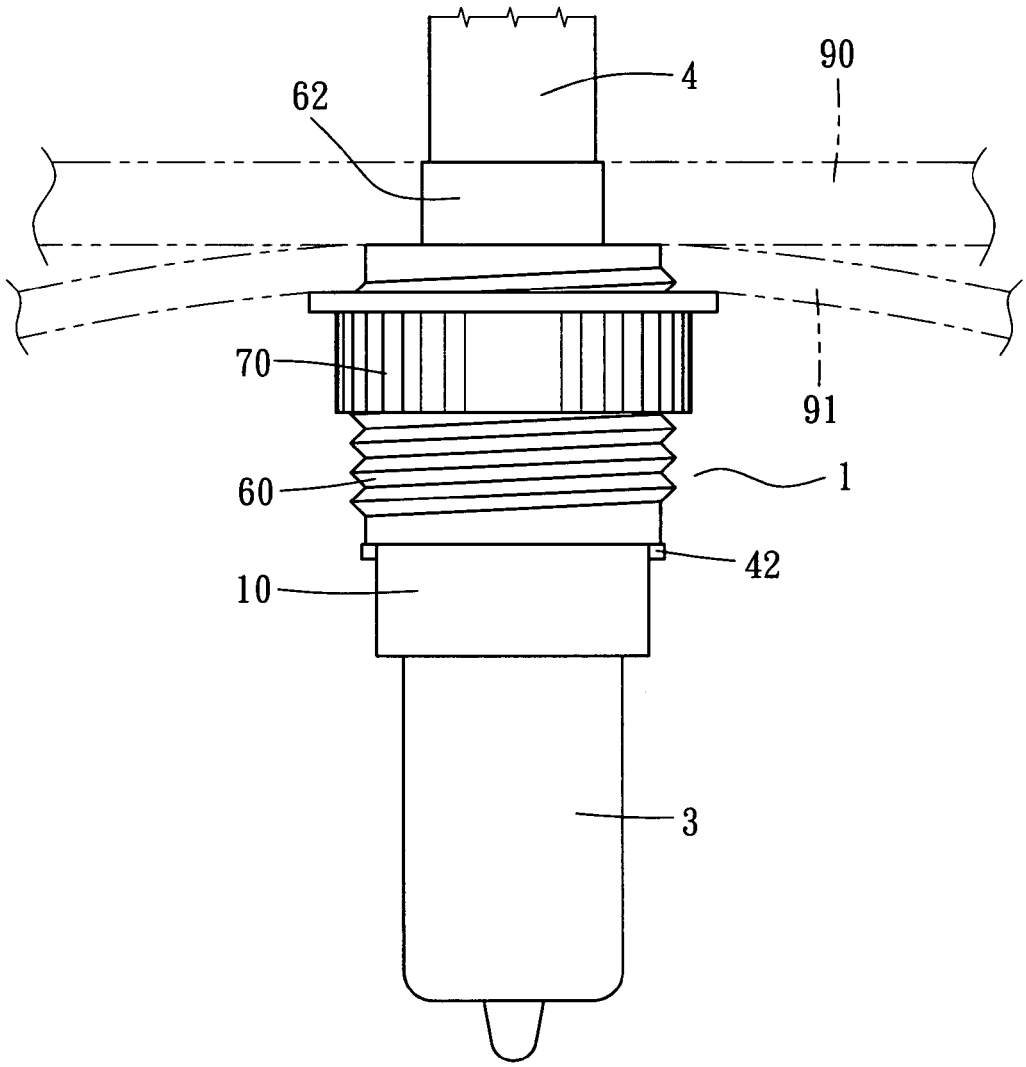
FIG. 12 is a top view of another preferred embodiment of a halogen lampholder in the present invention, showing it in an assembled condition.

In FIGS. 1–9, although the vertical plugging chamber 11 of the base 10 is devised to stay as the top of the halogen lampholder 1, yet it's not necessary to be like that. As shown in FIG. 12, the vertical plugging chamber 11 can be designed to face downwards to let the lamp 3 radiate downwards as well, with the inner threaded column 62 of the outer shell 60 fixed on a fixing board 90 and a lampshade 91 fitted between the fixing board 90 and the outer ring 70, forming the halogen lampholder 1 with the lampshade 91 to let the light of the halogen lamp radiate downward as long as the lamp 3 is lit up.

The components of the preferred embodiments in the present invention, as mentioned above, can be disassembled in a reverse procedure. Therefore, each component can be manufactured independently to reduce the cost. And, such easy assembly and disassembly are convenient for the consumers to check up or clean up the interior, possible to achieve a better and longer life for the halogen lampholder.

While the preferred embodiment of the invention has been described above, it will be recognized and understood that various modifications may be made therein and the appended claims are intended to cover all such modifications that may fall within the spirit and scope of the invention.

What is claimed is:

1. A halogen lampholder comprising:

a base having a vertical plugging chamber at its one end for a fitting portion of a halogen lamp and two conducting teeth under said fixing portion to plug in, said base further having two accommodating chambers at its front and rear side respectively connected with said vertical plugging chamber by a connecting groove at its bottom and provided for containing a locking spring member, said locking spring member possessing a transversal leaning plate and a locking plate set to extend upright from two sides of said transversal leaning plate respectively, each said locking plate formed of a hump in its intermediate portion and a bended clipping end at its top, said transversal leaning plate put in said connecting groove, said locking plates placed in said accommodating chambers, said bended clipping heads to be settled in said vertical plugging chamber for clamping said fixing portion of said lamp, said each accommodating chamber having a sliding groove at its two sides respectively for a sliding rail formed at two sides of a sliding member respectively to move along, each said sliding member having a projecting pusher at its rear side for supporting said locking spring member on a spot near said hump, a bottom fixing cavity set at the bottom of said base and two sides of said connecting groove respectively and communicating with said vertical plugging chamber, each said bottom fixing cavity inserted by a clipping member that has a bended clipping end to be plugged into and to stay at the edge of said vertical plugging chamber, two fixing plates placed in said bottom fixing cavity and a wire clipping plate formed by a bended extension of said fixing plate, each said bended clipping end of said clipping member contacting with said each conducting tooth of said halogen lamp, each said wire clipping plate pushed by one end of a power wire to get bended so that said power wire is clamped together tightly by said wire clipping plate and said insert plates, said base having two fixing grooves and four locking grooves in the other end, each said sliding groove formed of a transversal groove in its intermediate portion;

a bottom cover having hooks, a wall body and locking grooves around its circumference, a transversal locking bar and two piercing holes formed in its upper surface, said bottom cover combined completely with said base by locking said hooks with said fixing grooves of said base, said wall body fitted with said locking grooves and said transversal locking bar rested on said transversal leaning plate, said piercing holes of said locking spring member passed through by said power wire; and, an outer shell provided with an opening at its one end for containing said base and said bottom cover therein and an inner threaded column at the other end for said power wire to pass through, two projections set symmetrically in the inner wall of said opening and inserted into said locking grooves of said bottom cover and then moved to reach and position stably in said transversal grooves to finish the assembly of said outer shell with said base by rotating said outer shell against said base, said sliding members finally retreated to openings of said transversal grooves to prevent said projections from moving away so as to keep said base, said bottom cover and said outer shell assembled firmly together.

2. A halogen lampholder as claimed in claim 1, wherein said outer shell is formed with male threads on its outer wall for screwing with inner female threads of an outer ring.

3. A halogen lampholder as claimed in claim 1, wherein said inner threaded column of said outer shell is screwed with an outer threaded portion of a power wire tube, which is provided for said power wire to pass through.

* * * * *